US009114500B2

(12) United States Patent
Sugita et al.

(10) Patent No.: US 9,114,500 B2
(45) Date of Patent: Aug. 25, 2015

(54) SANDER HAVING BATTERY PACK

(71) Applicant: Makita Corporation, Anjo-shi, Aichi (JP)

(72) Inventors: Fumihide Sugita, Anjo (JP); Masahiko Inai, Anjo (JP); Hirokazu Hagiwara, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 223 days.

(21) Appl. No.: 13/718,465

(22) Filed: Dec. 18, 2012

(65) Prior Publication Data

US 2013/0165026 A1 Jun. 27, 2013

(30) Foreign Application Priority Data

Dec. 21, 2011 (JP) ..... 2011-280179
Dec. 21, 2011 (JP) ..... 2011-280181
Dec. 21, 2011 (JP) ..... 2011-280182

(51) Int. Cl.
*B24B 23/04* (2006.01)
*B24B 23/02* (2006.01)
*B24B 23/03* (2006.01)

(52) U.S. Cl.
CPC ..... *B24B 23/04* (2013.01); *B24B 23/02* (2013.01); *B24B 23/03* (2013.01)

(58) Field of Classification Search
CPC ..... B24B 23/04; B24B 23/02; B24B 23/03; B24B 23/028; B24B 23/00
USPC ..... 451/354, 355, 356, 357, 358, 359
See application file for complete search history.

(56) References Cited

U.S. PATENT DOCUMENTS

| | | | | |
|---|---|---|---|---|
| 3,199,251 | A * | 8/1965 | Enders | 451/356 |
| 3,900,974 | A * | 8/1975 | Klebe et al. | 451/357 |
| 4,242,839 | A * | 1/1981 | Armbruster et al. | 451/357 |
| D326,398 | S | 5/1992 | Fushiya et al. | |
| 6,846,230 | B2 * | 1/2005 | Jonas | 451/359 |
| 7,115,018 | B1 * | 10/2006 | Syverson | 451/6 |
| 7,270,591 | B2 | 9/2007 | Deshpande et al. | |
| 7,291,062 | B2 | 11/2007 | Kiss et al. | |
| 2002/0100597 | A1 * | 8/2002 | Numata | 173/217 |
| 2006/0068689 | A1 | 3/2006 | Kiss et al. | |
| 2006/0116058 | A1 * | 6/2006 | Bosten et al. | 451/356 |
| 2008/0009951 | A1 | 1/2008 | Hodge | |

(Continued)

FOREIGN PATENT DOCUMENTS

| | | |
|---|---|---|
| CN | 201295872 Y | 8/2009 |
| EP | 1 612 001 | 7/2004 |

(Continued)

OTHER PUBLICATIONS

Aug. 4, 2014 Search Report issued in European Application No. 12190012.0.

(Continued)

*Primary Examiner* — Timothy V Eley
(74) *Attorney, Agent, or Firm* — Oliff PLC

(57) ABSTRACT

A sander is of a palm type, and its upper portion is configured as a holding portion. A battery attachment portion to which a battery having an elongated shape is attachable is oriented at an angle not less than 0 degrees with respect to a vertical direction, such that if a longitudinal direction of the battery is angled, a lower portion of the battery is in a position shifted inward farther than an upper portion of the battery.

13 Claims, 5 Drawing Sheets

(56) References Cited

U.S. PATENT DOCUMENTS

| | | | | |
|---|---|---|---|---|
| 2008/0014844 | A1* | 1/2008 | Pontieri | 451/359 |
| 2008/0254721 | A1 | 10/2008 | Wuensch | |
| 2008/0311830 | A1 | 12/2008 | Dineen et al. | |
| 2010/0009608 | A1 | 1/2010 | Lo et al. | |
| 2010/0120340 | A1 | 5/2010 | Fukinuki et al. | |
| 2010/0186980 | A1* | 7/2010 | Heilig et al. | 173/217 |
| 2012/0135671 | A1* | 5/2012 | Klabunde et al. | 451/358 |
| 2012/0157257 | A1* | 6/2012 | Hirabayashi et al. | 475/159 |

FOREIGN PATENT DOCUMENTS

| | | | |
|---|---|---|---|
| EP | 1 911 547 | | 8/2008 |
| EP | 2 002 932 | | 12/2008 |
| EP | 2 156 925 | | 2/2010 |
| JP | S62-297066 | A | 12/1987 |
| JP | A-06-226709 | | 8/1994 |
| JP | A-2002-144210 | | 5/2002 |
| JP | 2002-301651 | A | 10/2002 |
| JP | 2005-279891 | A | 10/2005 |
| JP | A-2008-284657 | | 11/2008 |
| JP | 2009-166148 | A | 7/2009 |
| JP | A-2009-166147 | | 7/2009 |
| JP | 2009-220215 | A | 10/2009 |
| WO | WO 2013/093619 | A2 | 6/2013 |

OTHER PUBLICATIONS

Nov. 14, 2014 Office Action issued in Chinese Application No. 2012105444739 (with translation).

Mar. 17, 2015 Office Action issued in Japanese Application No. 2011-280181.

Mar. 17, 2015 Office Action issued in Japanese Application No. 2011-280182.

* cited by examiner

SANDER HAVING BATTERY PACK

BACKGROUND OF THE INVENTION

This application claims the benefit of Japanese Patent Application Numbers 2011-280179 filed on Dec. 21, 2011, 2011-280181 filed on Dec. 21, 2011 and 2011-280182 filed on Dec. 21, 2011, the entirety of which is incorporated by reference.

TECHNICAL FIELD

The present invention relates to a sander with a holding portion provided on its top.

BACKGROUND ART

A battery-operated cordless sander of a type known in the art as disclosed in U.S. Pat. No. 7,291,062 (U.S. Pat. No. 7,291,062 B2) is typically operated with one hand holding a holding portion disposed at an upper side of its housing opposite to bottom side at which a pad is disposed, such that an operator can hold it in one hand, and thus is called a palm type. The sander of this type includes a battery disposed within an upper portion of the housing and held with its longitudinal direction oriented horizontally.

Since the battery of this sander is housed in the housing, the battery is difficult to change. Therefore, in many cases, some inconvenience would be imposed on an operator. For example, the battery, once exhausted, could not be replaced with another fully-charged battery, making the sander unable to continuously be used. Further, once the battery reaches the end of its useful life, an operator is required to open the housing. Moreover, since the battery of this sander is disposed with its longitudinal direction oriented horizontally, its center of gravity could not be brought into as low a position as desired, and the shape of the housing would be elongated and could not be made as compact as desired.

With these in view, another type of sander, though being of a non-palm type, that is, with a longer holding portion to be held by two hands and an externally mounted battery is proposed as disclosed in Japanese Laid-open Patent Application, Publication No. 2009-166147 (JP 2009-166147 A). In the sander of this type, the battery, once exhausted, can be replaced with another fully-charged battery, making the sander operable for successive use, and once reaching the end of its useful life, can be easily made operable by replacing it with another battery.

As disclosed in Japanese Laid-open Patent Application, Publication No. 6-226709 (JP 6-226709 A), a sander may include a fan for purposes of dust collection or cooling. The fan of this sander is attached to an output shaft (rotation shaft) of a motor for driving a pad at the bottom of the sander.

As disclosed in Japanese Laid-open Patent Application, Publication No. 2002-144210 (JP 2002-144210 A), a sander may include a main body housing having an upper portion so rounded as to be adapted for being grasped by a hand. The sander of this type includes a switch provided on the upper portion of the main body housing, so that the sander can be activated (powered on) or deactivated (powered off) by operating (turning) the switch.

SUMMARY OF THE INVENTION

The sander of the palm type as disclosed in U.S. Pat. No. 7,291,062 B2 would conceivably be improved by introducing an external battery configuration as disclosed in JP 2009-166147 A. In such a case, in order to properly provide a holding portion in a manner that would not interfere with an operator's hand(s), the battery would inevitably have to be located in a position remote from the center of the product (sander main body).

Since the battery is a relatively heavy object, such a heavy object located in a position remote from the center of the product would disadvantageously create imbalance in weight. In particular, the heavy object located in a position remote from the center of rotation of the abrasive pad would cause undesirably great vibrations and the like, and thus could possibly hinder the operation.

Thus, it is a first aspect of the present invention to provide a sander with which a battery can be changed and a sufficiently wide and easy-to-hold holding portion is provided so as to achieve a stable operation.

The sander as disclosed in JP 6-226709 A in which a fan is directly attached to the downwardly protruding rotation shaft of the motor would require the motor to be disposed above the center of the fan. The sander would thus tend to have an increased height in its entirety. Moreover, since the fan is attached to the rotation shaft of the motor, the fan and the motor combined in a single unit would have to be arranged together and thus could not be arranged flexibly. Furthermore, if the fan should be designed to have a greater size (wider in horizontal directions), wasted space would be produced at the sides of the motor (above the fan), which would increase the external dimensions of the sander, and thus impair its compactness. Conversely, if priority should be given to the compactness, the size of the fan implementable would be limited, and thus the dust-collecting and cooling capabilities (the performance and efficiency of the fan) would possibly be so limited as not to reach desirable levels.

Thus, it is a second aspect of the present invention to provide a sander which embodies the following features: (i) less limitation on arrangement of a motor and a fan, and (ii) a sufficiently increased size (enough to achieve a sufficient performance) of the fan, and in which the features (i) and (ii) are realized in a compact body.

The sander as disclosed in JP 2002-144210 A in which only a switch for turning on or off the operation is provided would only accept the commands of starting and stopping the rotation of the pad, and could not accept the other commands for other operations.

Thus, it is a third aspect of the present invention to provide a sander which can accept not only the commands for starting and stopping the operation but also any other commands for various kinds of operations, and which is easy to perform such operations of various kinds.

Exemplary and more specific configurations as may be consistent with the aforementioned first aspect will be described below.

(1) According to one or more embodiments, a sander proposed herein comprises an upper portion configured as a holding portion, a pad, and a motor configured to drive the pad, wherein a battery configured to power the motor is installable in the sander. The battery has an elongated shape of which a longitudinal direction is, when the battery is attached, oriented at an angle not less than 0 degrees with respect to a vertical direction, such that, if the longitudinal direction is angled, a lower portion of the battery is in a position shifted inward farther than an upper portion of the battery.

(2) In the above configuration (1), additionally, the sander may further comprise an attachment portion to which the battery is attachable, and the motor may be disposed on a side opposite to the attachment portion with respect to a position of the holding portion.

(3) In the above configuration (1), with or without the feature (2), the pad may be configured to receive a reduced speed driving force derived from a driving force of the motor to make a rotational motion and an eccentric motion.

(4) In the above configuration (1), with or without any of the features (2) and (3), an inner edge of the lower portion of the battery as attached may be positioned inward beyond an outer edge of the pad.

(5) In the above configuration (1), with or without any of the features (2), (3) and (4), the longitudinal direction of the battery may be angled at an angle greater than 0 degrees and not greater than 30 degrees with respect to the vertical direction.

(6) In the above configuration (1), with or without any of the features (2), (3), (4) and (5), an upper edge of the upper portion of the battery as attached may be positioned in alignment with an upper edge of the holding portion in the vertical direction.

(7) In the above configuration (1), with or without any of the features (2), (3), (4), (5) and (6), the sander may further comprises an output shaft to which the pad is attached, and a fan provided on the output shaft, and the motor may comprise a rotation shaft which is connected to the output shaft via a speed reducer configured to reduce a speed with which a rotation of the rotation shaft is transmitted to the output shaft.

(8) The speed reducer as mentioned above in describing the feature (7) may include a reduction member which has a vent.

(9) The sander configured as described above in (1) with or without any of the features (2) through (8) may further comprise a power switch and a speed change switch for the motor, which power switch and speed change switch are arranged on a flat surface.

(10) The flat surface as mentioned above in describing the feature (9) may be disposed beside the holding portion.

Exemplary and more specific configurations as may be consistent with the aforementioned second aspect will be described below.

(A1) According to one or more embodiments, a sander proposed herein comprises an upper portion configured as a holding portion, a pad, a motor configured to drive the pad, and an output shaft to which the pad is attached, wherein the motor comprise a rotation shaft which is connected to the output shaft via a speed reducer configured to reduce a speed with which a rotation of the rotation shaft is transmitted to the output shaft, and a fan is provided on the output shaft.

(A2) In the above configuration (A1), additionally, the speed reducer may include a reduction member which has a vent.

(A3) The reduction member as mentioned above in describing the feature (A2) may be provided on the output shaft.

(A4) In the above configuration (A1), with or without any of the features (A2) and (A3), the fan may include a balance portion provided to adjust a rotation mode of the pad.

(A5) The sander configured as described above in (A1) with or without any of the features (A2), (A3) and (A4) may further comprise a housing such that a portion of the housing at a side of the fan is configured as an extension portion which extends outward relative to other portions of the housing.

Exemplary and more specific configurations as may be consistent with the aforementioned third aspect will be described below.

(B1) According to one or more embodiments, a sander proposed herein comprises an upper portion configured as a holding portion, a pad, a motor configured to drive the pad, and a power switch and a speed change switch for the motor, which power switch and speed change switch are arranged on a flat surface.

(B2) The flat surface as mentioned above in describing the feature (B1) may be disposed beside the holding portion.

(B3) In the sander configured as described above in (B1) with or without the feature (B2), the power switch and speed switch as mentioned above in (B1) may be arranged laterally side by side as viewed from a direction facing to the flat surface 60.

(B4) In the above configuration (B1) with or without any of the features (B2) and (B3), the sander may further comprise a housing including a constriction above which the holding portion is formed, wherein a distance between a center of the power switch and a center of the speed change switch is smaller than a distance between most constricted positions of the constriction.

(B5) In the above configuration (B1), with or without any of the features (B2) to (B4), the flat surface may be tilted with an upper side positioned inward.

According to the configurations described above in (1), (7) to (10), the elongated battery is positioned to have its longitudinal direction oriented at an angle not less than 0 degrees with respect to the vertical direction, such that if the longitudinal direction is angled, the lower portion of the battery is in a position shifted inward farther than the upper portion of the battery, and thus the holding portion can be designed to be broader enough, and the weight balance can be shifted to the center so that the operation can be stabilized.

With the feature described above in (2), the motor is disposed on the side opposite to the battery, and thus relatively heavy-weight parts, the battery and the motor, can be disposed oppositely with respect to the holding portion, so that the weight balance can be materially improved.

With the feature described above in (3), the pad makes a rotational motion while making an eccentric motion with a reduced speed by the driving force from the motor, and thus a sander, particularly of such a type as likely to vibrate, can be provided with an improved weight balance in comparison with a sander in which a pad only makes a rotational motion without making an eccentric motion. Therefore the operation is stabilized effectively.

With the feature described above in (4), at least part of the battery is positioned above the pad, and thus the weight of the battery is applied from above onto the pad which receives a reaction force from a workpiece. Therefore, the weight balance can be effectively improved, and the operation is stabilized more.

With the feature described above in (5), the longitudinal direction of the battery can be angled at an angle greater than 0 degrees and not greater than 30 degrees with respect to the vertical direction. Therefore, the sander can be designed to have a miniaturized body while making a sufficiently large inner space inside.

With the feature described above in (6), the upper edges of the holding portion and the battery as attached are aligned with each other, and thus the sander can be designed to make its upper portion less likely to interfere with the operator's hand, so that the sander can be provided with improved ease of operation.

According to the configurations described above in (A1), the fan is provided on the output shaft connected to the rotation shaft of the motor via the speed reducer, and thus the motor and the fan can be positioned with their centers out of alignment with each other as viewed from the vertical direction, i.e., shifted horizontally. Therefore, the height of the sander can be reduced, for example, by locating the motor above the peripheral edge of the fan. As a result, the sander can be designed to be sufficiently compact to such an extent as to be required generally for this particular type of sander with its upper portion configured as a holding portion. Furthermore, since the necessity to align the centers of the motor and the fan with each other is obviated, the fan is not necessarily to be disposed such that the peripheral edge of the fan protrudes out equally beyond the peripheral edge of the motor when the fan is designed to be upsized. Therefore, the fan can be upsized to achieve an increased air-current producing efficiency without impairing the compactness of the sander. Furthermore, by making use of the speed reducer, the relationship between the output of the motor and the torque of the fan can be adjusted, and thus the flexibility in design can be enhanced. For example, a motor having a relatively low power output may be adopted to place the compactness on a higher priority while keeping a sufficient rpm of the fan. Or a fan having a relatively large diameter and heavy in weight may be adopted to place the air-current producing efficiency of the fan on a higher priority while keeping the operability sufficient to drive the fan with a reduced speed of the output shaft.

With the feature described above in (A2), in which a vent is provided in the reduction member of the speed reducer, air forced to flow by the fan can be allowed to pass through the vent smoothly. Accordingly, the efficiencies of cooling and the like can be improved.

With the feature described above in (A3), in which, in addition to the feature described in (A2), the reduction member is provided on the output shaft, the obstruction of airflow by the reduction member disposed in the center of the inside of the sander can be mitigated. Accordingly, the efficiencies of cooling and the like can be improved further.

With the feature described above in (A4) in which the balance portion is provided in the fan, the fan can be configured to serve as a counterweight, and thus the rotation of the pad can be rendered stable. Moreover, in comparison with an alternative configuration where a dedicated counterweight is provided, the sander can be designed to be compact in its entirety.

With the feature described above in (A5) in which a portion of the housing outside the fan is configured to extend outward, the other portion of the housing (other than the extension portion) can be designed to be constricted and thus rendered easy to grasp and/or compact in size. Furthermore, if the housing is designed to have the portion other than the extension portion configured to be grasped, the user's hand which would tend to slip can be stopped by the extension portion. As a result, the operation can be carried out stably, safely and accurately.

According to the configurations described above in (B1), the power switch and the speed change switch are both arranged on one and the same flat surface, and thus can be manipulated easily. That is, for example, the speed change operation can be performed through the speed change switch only by shifting a finger for a short distance from a position in which the power-on operation is performed through the power switch. In this way, a sander that is easy to perform the both of the speed change operation and the power-on/off operation can be provided.

With the feature described above in (B2) in which the flat surface described in (B1) is disposed beside the holding portion, the switches are arranged beside the holding portion, and thus the switches can be manipulated while the sander is held by hand. Accordingly, the sander can be designed to provide a materially improved operability.

With the feature described above in (B3) in which the power switch and the speed change switch are arranged laterally side by side as viewed from a user holding the holding portion, the transition between the power switch manipulatable position and the speed change switch manipulatable position can be achieved simply by shifting a finger to the right or to the left. Accordingly, the operations can be made easier to perform.

With the feature described above in (B4) in which the distance between the center of the power switch and the center of the speed change switch is smaller than the distance between the narrowest positions of the constriction under the holding portion. Therefore, the need for moving the hand or finger for a considerable distance, which would arise when the operator's hand should be transitioned from the power switch manipulatable position to the speed change switch manipulatable position or vice versa, can be obviated. Therefore, the operations can be made still easier to perform.

With the feature described above in (B5) in which the flat surface is tilted with its upper side positioned toward the center of the housing, the switches are arranged such that the operator's finger will be guided naturally to each switch. Accordingly, the control panel ergonomically conformable to the human hand, as would not hinder the operator's hand from manipulating the switches, can be provided.

BRIEF DESCRIPTION OF DRAWINGS

The above and other aspects, other advantages and further features of the present invention will become more apparent by describing in detail illustrative, non-limiting embodiments thereof with reference to the accompanying drawings.

DESCRIPTION OF EMBODIMENTS

An illustrative embodiment of the present invention will be described in detail with reference to the drawings.

Figure 1:
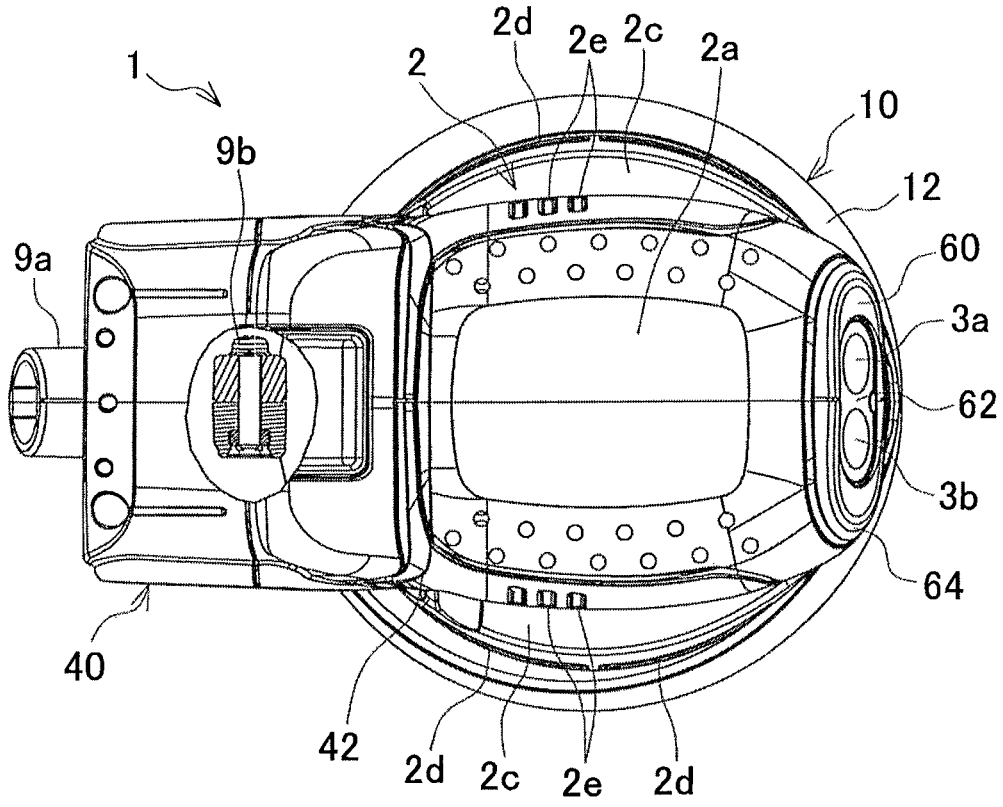
FIG. 1 is a partially cutaway plan view of a sander according to an illustrative embodiment of the present invention.
Figure 2:
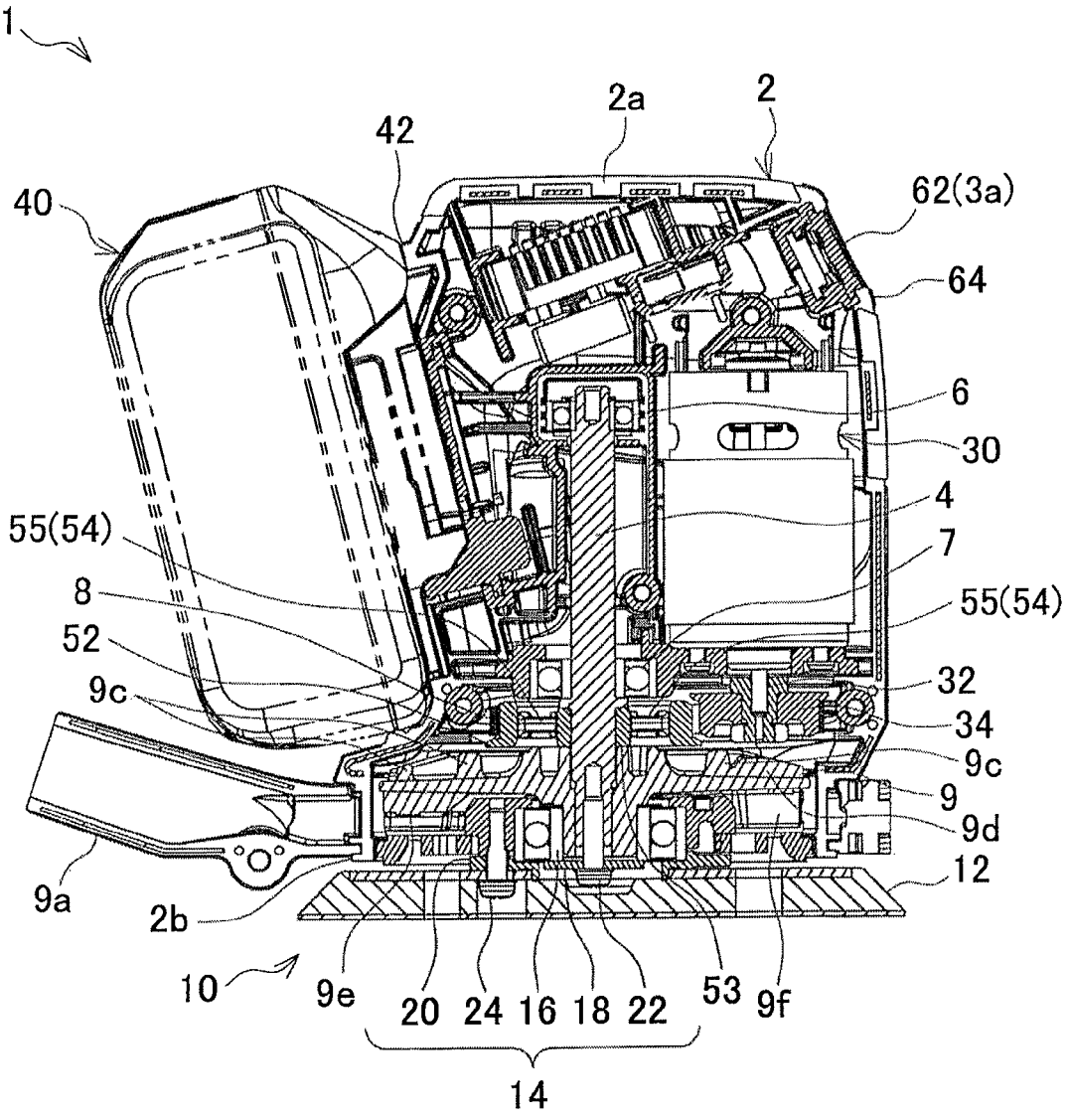
FIG. 2 is a sectional view vertically taken along a center line of FIG. 1.

As shown in FIG. 1 which is a partially cutaway plan view of a sander 1 (of which the front side faces to the right hand side of the drawing sheet) and FIG. 2 which is a sectional view vertically taken along a center line of FIG. 1. The sander 1 is of a palm type, and is configured to be operable by a user with a single hand holding an upper portion 2*a* (holding portion) of a housing 2. Beside the upper portion 2*a*, buttons 3*a*, 3*b* are provided.

The sander 1 includes an output shaft 4 which is disposed to extend vertically, rotatably on its central axis, in the center within the housing 2. Ball bearings 6, 7 are provided on an upper portion and a middle portion, respectively, of the output shaft 4 around the peripheral surface of the output shaft 4. These ball bearings 6, 7 are disposed within the housing 2, and fixed relative to the housing 2.

Further, on the middle portion of the output shaft 4, a pulley 8 is fixed to the output shaft 4 in a position under the ball bearing 7 around the peripheral surface of the output shaft 4, and a fan 9 is fixed to the output shaft 4 in a position under the pulley 8 around the peripheral surface of the output shaft 4.

The fan 9 is a member which is shaped generally like a disc, and disposed substantially in a horizontal position. A plurality of vanes 9*c* radiating from the center to the peripheral edges and curving to bulge upward are formed at one side, and some of the peripheral edges of the vanes 9*c* are combined together at their outer edges to form a thick portion 9*e*. Similarly, a plurality of vanes 9*d* radiating from the center to the peripheral edges and curving to bulge downward are formed at the other side, and some of the peripheral edges of the vanes 9*d* are combined together at their outer edges to form a thick portion 9*f*. The thick portion 9*e* and the thick portion 9*f* are disposed in positions symmetrical with respect to a point.

The vanes 9*d* are inwardly shorter than the vanes 9*c* so as to form a space which accommodates a pad bearing device 14 including a ball bearing 16 and other parts. This serves to make the sander 1 compact in size in the vertical direction.

A lower portion of the housing 2 includes a fan containing part in which the fan 9 is housed. This fan containing part is configured as an extension portion 2*c* which extends to right and left sides relative to an adjacent upper portion of the housing 2. At an outer (right or left) side of each extension portion 2*c*, windows 2*d* are provided for letting out air forced to flow by the fan therethrough. The aforementioned adjacent upper portion of the housing 2 extends continuously from an upper end of each extension portion 2*c* to a lower end of the upper portion 2*a*. This portion of the housing 2 is thus recessed relative to the extension portion 2*c* that extends at a lower side thereof and also to the upper portion 2*a* that also bulges out to a right or left side at an upper side thereof, so that a constriction 44 is formed between the upper end of the extension portion 2*c* and the lower end of the upper portion 2*a* in the housing 2.

At a lower portion of the housing 2, beside the fan 9 (under a battery attachment portion 42 which will be described later), a connection portion 2*b* is formed to which a dust collection tube 9*a* for ejecting dust collected by the fan 9 is connected. The dust collection tube 9*a* is fixed to the connection portion 2*b* via a connecting screw 9*b*.

Figure 3:
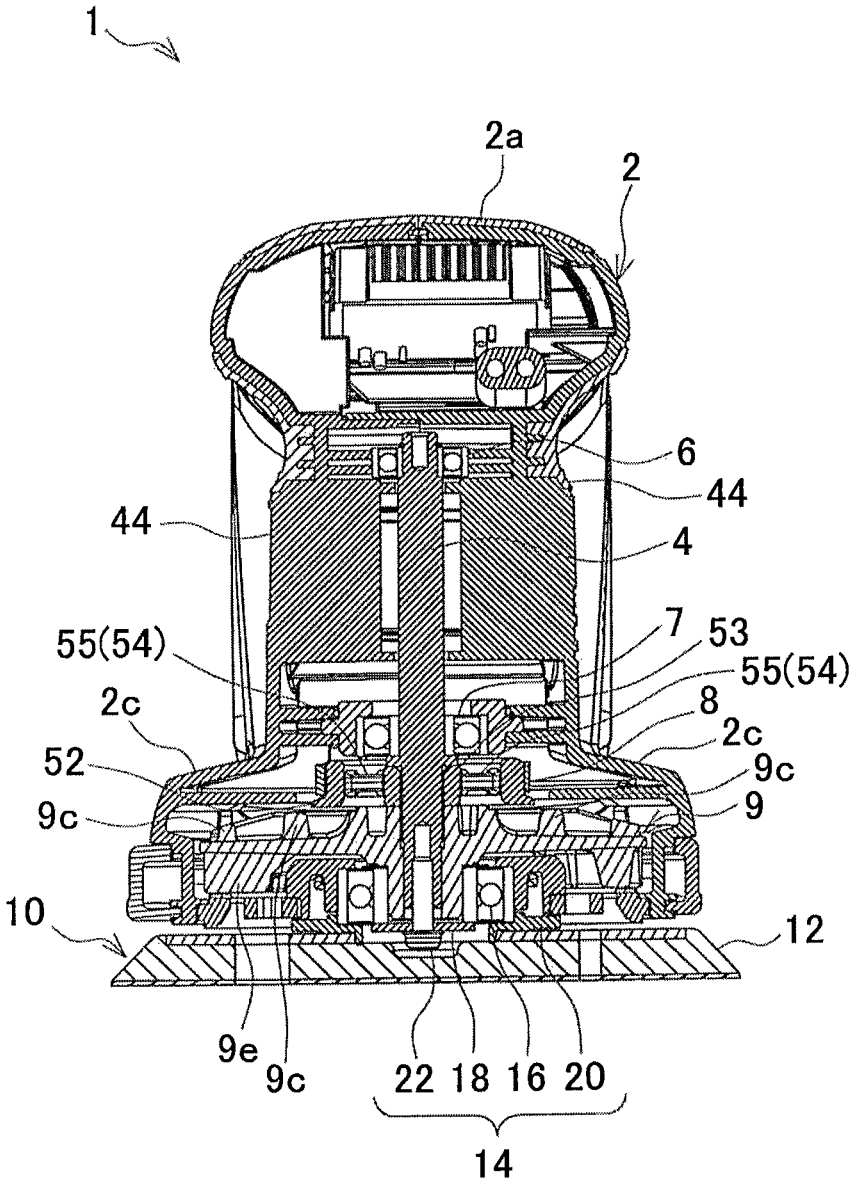
FIG. 3 is a sectional view vertically taken along a line containing an axis of an output shaft of the sander in FIG. 1.

As shown in FIG. 3, which is a sectional view vertically taken along a line containing an axis of the output shaft 4 of the sander 1 in FIG. 1, a pad 10 is attached to a distal end of the output shaft 4. A sheet of sanding paper (not shown) as an example of an abrasive tool is attached to an undersurface of the pad 10 via a hook and loop fastener or the like.

The pad 10 includes a pad body 12 and a pad bearing device 14 disposed on an upper side of the pad body 12. The pad bearing device 14 includes a ball bearing 16, an inner bearing retainer 18 (flat washer) fixed to an inner race of the ball bearing 16, and an outer bearing retainer 20 fixed to an outer race of the ball bearing 16.

The inner bearing retainer 18 has a hole provided in a position shifted from the rotation axis of the ball bearing 16 so that an inner screw 22 is allowed to pass through this hole to fit inside a distal end portion of the output shaft 4. The inner bearing retainer 18 is disposed under the inner race of the ball bearing 16, to support the ball bearing 16 from below. A lower projection of the fan 9 is disposed in an inside of the inner race of the ball bearing 16, and the output shaft 4 is disposed inside the lower projection.

Holes through which an outer screw 24 used to connect the outer bearing retainer 20 and the pad body 12 is allowed to pass are provided in both of the outer bearing retainer 20 and the pad body 12.

The thick portions 9*e*, 9*f* of the fan 9 are provided as weights in the above-described positions predetermined in view of the off-center configuration of the pad 10, and serve as counterweights for adjusting the rotational motion and the eccentric motion (orbital motion) which the pad 10 makes with the help of the ball bearing 16 and other members.

A motor 30 is fixed beside the output shaft 4 within the housing 2.

A motor-side pulley 34 as part of a reduction member is fixed to a rotation shaft 32 of the motor 30. A belt (a timing belt, not shown) as part of the reduction member is looped around the motor-side pulley 34 and the aforementioned output shaft-side pulley 8. The motor-side pulley 34 is smaller in diameter than the output shaft-side pulley 8, and thus the rotation of the rotation shaft 32 is transmitted to the output shaft 4 with reduced speed.

A battery 40 is attached to a side, i.e., the outside of the housing 2, opposite to the motor 30, with the upper portion 2*a* and the output shaft 4 being disposed between the battery 40 and the motor 30. In other words, the motor 30 is disposed on a side opposite to the battery 40 with respect to the position of the holding portion or the output shaft 4.

The battery 40 is shaped generally like a rectangular parallelepiped with rounded sides and corners. On one surface of the battery 40, one or more terminals (not shown) are provided.

The battery 40 is a rechargeable battery which can be recharged by a battery charger. Therefore, the sander 1 is of a rechargeable type. The buttons 3*a* and 3*b* are electrically connected to the motor 30 and the battery 40, respectively, so that these buttons 3*a*, 3*b* serve as switches for the motor 30 and the battery 40.

An outer surface of the housing 2 on a side opposite to the side on which the motor 30 is disposed is configured as a battery attachment portion 42 shaped to correspond to the shape of the surface of the battery 40 on which the terminal(s) are provided.

The battery attachment portion 42 is tilted with its lower portion shifted inward so that the battery 40 ready for attachment may rest tilted on and guided by the battery attachment portion 42 with its upper portion being in a position farther than a lower portion from the axis of the output shaft 4 (angled with respect to the vertical direction of the sander 1). To be more specific, the battery 40 can be detached from or attached to the battery attachment portion 42 by a user placing the battery 40 in alignment with the battery attachment portion 42 and sliding it along the angled battery attachment portion 42. The battery attachment portion 42 includes a stopper portion (not shown) for engagement with the battery 40. When the battery 40 is attached, the stopper portion is engaged with the battery 40, when the battery is removed, the stopper portion is disengaged from the battery 40. In this way, the battery 40 is detachably attachable to the sander 1. The battery attachment portion 42 includes terminals (not shown) which contacts with the terminals of the battery 40 when the battery 40 is attached. The terminals of the battery attachment portion 42 are electrically connected to the motor 30, so that electrical power of the battery 40 as attached can be supplied to the motor 30.

The battery 40 as attached to the battery attachment portion 42 is in a position such that its lower portion is closer to the center of the sander 1 (housing 2) than its upper portion (i.e., the lower portion of the battery 40 is in a position shifted inward farther than the upper portion of the battery 40). The pad 10, the battery 40 and the battery attachment portion 42 are configured such that the lower portion of the battery 40 as attached (an inner edge thereof) is positioned inward beyond an outer edge of the pad 10 (a contact portion thereof).

The battery 40 as attached (a center line thereof extending in its longitudinal direction) is angled at 14 degrees with the vertical line according to the present embodiment shown in FIG. 1.

Furthermore, the battery 40 and the battery attachment portion 42 are configured such that an upper edge of the battery 40 as attached is continuously aligned with the upper portion 2*a* (upper edge thereof) of the housing 2.

Figure 4A:
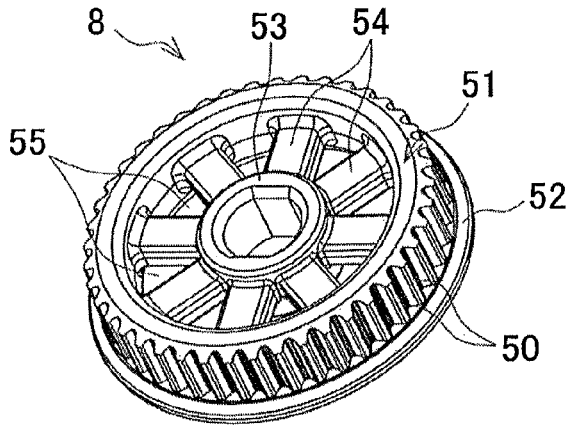
FIG. 4A is a perspective view of a pulley of the sander shown in FIG. 1.
Figure 4B:
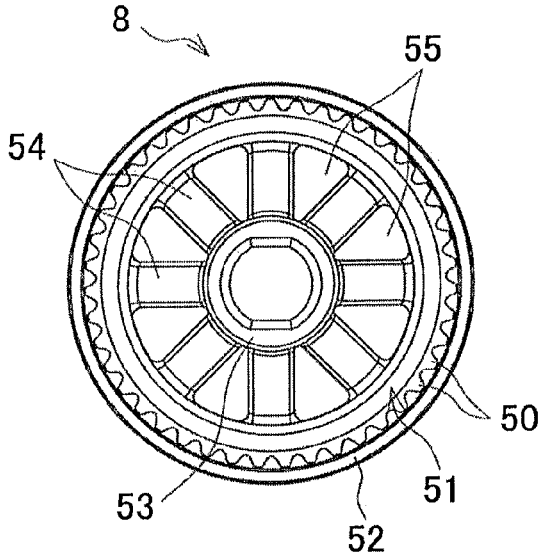
FIG. 4B is a plan view of the pulley of the sander shown in FIG. 1.
Figure 4C:
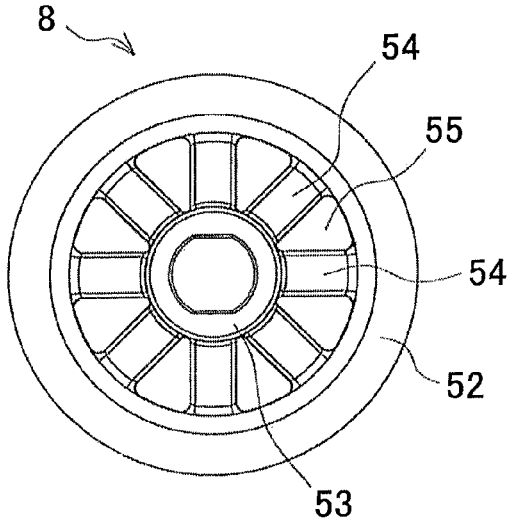
FIG. 4C is a bottom view of the pulley of the sander shown in FIG. 1.

As shown in FIG. 4, the output shaft-side pulley 8 includes a generally ring-shaped toothed portion 51 having a plurality of teeth 50 provided on a peripheral surface around which the aforementioned belt is looped, a flange portion 52 provided at a lower end of the toothed portion 51 and projecting radially outward beyond the crests of the teeth 50, a center hole portion 53 shaped substantially like a ring to allow the output shaft 4 to be fitted therein, and a plurality of columnar portions 54 connecting the inside of the toothed portion 51 and the outside of the center hole portion 53. Portions surrounded by the toothed portion 51 and the columnar portions 54 (and the center hole portion 53) serve as vents 55. In this way, the output shaft-side pulley 8 has a plurality of vents 55.

The output shaft-side pulley 8 is configured to pass air through these vents 55 upward and downward.

Figure 5:
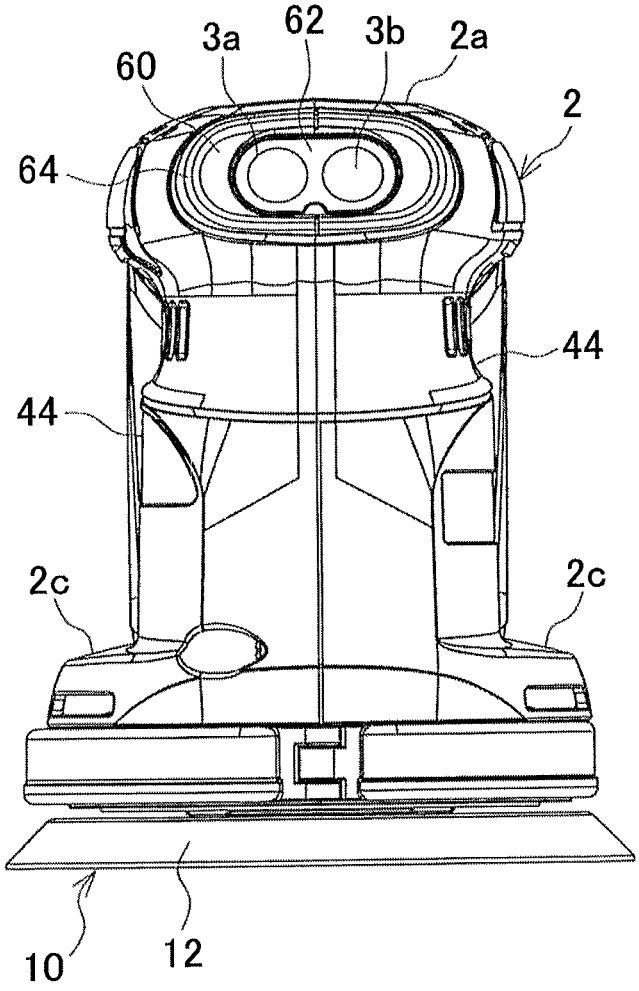
FIG. 5 is a front elevation of the sander shown in FIG. 1.

As also shown in FIG. 5, the buttons 3*a*, 3*b* are arranged on a flat surface 60 formed at a front side of the upper portion 2*a* of the housing 2. The flat surface 60 is formed symmetrically with respect to a vertical center line which bisects it into left and right parts. The buttons 3*a*, 3*b* are arranged on the flat surface 60 symmetrically at the left and at the right (as viewed from a direction facing to the flat surface 60). Moreover, the flat surface 60 is formed as a slope tilted with its upper side positioned rearward (closer to the center of the sander 1 or the housing 2).

The distance between the centers of the buttons 3*a* and 3*b* is, for example, 15 mm. In order to facilitate the operation of the buttons 3*a*, 3*b* performed with a single forefinger while the upper portion 2*a* being held using the other four fingers, the distance between the centers of the buttons 3*a* and 3*b* may preferably be 20 mm or smaller. This distance is smaller than the dimension (e.g., 60 mm) of a portion of the housing 2 having the smallest width, which is at the deepest position (the narrowest position) of the constriction 44.

The buttons 3*a*, 3*b* are configured to pop up, independently, at the front side of the button unit 62. The front side of the button unit 62 is located in the center of the flat surface 60. Streaked ribs 64 protruding to the front are formed around the flat surface 60.

The sander 1 configured as described above operates, for example, as follows.

When a battery 40 is attached to the battery attachment portion 42 of the sander 1, not in operation, and the button 3*b* is pressed down, electric power is supplied by the battery 40 to the motor 30, and the rotation shaft 32 starts to rotate at predetermined speed.

During operation of the sander 1, when the button 3*a* is pressed down, the electric power supplied from the battery 40 is interrupted, and the motor 30 is stopped, whereby the sander 1 is brought out of the operating state. During operation of the sander 1, when the button 3*b* is pressed down (several times), the rotation speed of the rotation shaft 32 is changed (in sequence of several speeds). For example, when the button 3*b* of the sander 1 not in operation is first pressed down, the rotation of the rotation shaft 32 starts at a predetermined initial speed. Subsequently, when the button 3*b* is pressed down for the second time, the rotation speed of the rotation shaft 32 is reduced from the initial speed by a predetermined rate. When the button 3*b* is pressed down for the third time, the rotation speed of the rotation shaft 32 is further reduced from the speed as reduced last time. When the button 3*b* is pressed down for the fourth time, the rotation speed of the rotation shaft 32 is restored to the initial speed. When the button 3*b* is pressed down further, the rotation speed of the rotation shaft 32 is shifted repeatedly in the same manner. Thus, the button 3*b* is considered to be a toggle switch.

The sander 1 is configured such that a power-on command is generated by pressing down the button 3*b* when the sander 1 is not in operation. Thus, strictly speaking, the button 3*b* also has a function of the power switch. However, it can be said that the main function of the button 3*b* is to generate a speed-change command, therefore, the button 3*b* may be considered to correspond to the speed change switch. Further, the button 3*a* which has a function of powering on the sander 1 may be considered to correspond to the power switch, because the button 3*a* can be used to power off the sander 1 and the button 3*b* cannot be used to power off the sander 1 even though the button 3*b* has the function of powering on the sander 1.

The rotation of the rotation shaft 32 of the motor 30 is transmitted through the pulley 34 fixed to the rotation shaft 32, and through the belt and the pulley 8, to the output shaft 4, so that the output shaft 4 is driven to rotate.

The rotation of the output shaft 4 causes the pad 10 to make a rotational motion and an eccentric motion as follows: the pad body 12 revolves around the ball bearings 6, 7 and the output shaft 4 through the ball bearing 16 and the outer ball bearing retainer 20. When a user operates the sander 1, an interactive force is exerted between the inner race and the balls and between the balls and the outer race, and a rolling resistance is thereby produced, so that the pad 10 rotates on the ball bearing 16 in the same direction as the direction of its revolution. When the sander 1 is caused to operate at no load (with the motor 30 running unloaded), the pad 10 may rotate irregularly or may not rotate because the frictional resistance within the ball bearing 16 is unstable.

The pad 10 configured to make a rotational and eccentric motion as described above may be pressed and moved on a workpiece with an operator's hand placed on the upper portion 2*a* of the housing 2, so that sanding paper or the like attached thereto is applied to the surface of the workpiece for polishing or other working.

Since the battery 40 as attached to the sander 1 is tilted as described above, the upper portion 2*a* of the housing 2 has proper shape and dimensions enough to provide its function as a holding portion. Moreover, the tilted position of the battery 40 as attached to the sander 1 serves to bring the position of its center of gravity toward the center of the sander 1 in comparison with an alternative configuration in which the position of the battery 40 as attached is not tilted. These advantages of the tilted position of the attached battery 40 can be achieved by setting the angle of the attached battery 40 relative to the vertical line at an angle not smaller than 0 degrees. If the battery 40 were tilted too much, the dimensions of the sander 1 would become too large, or the internal space of the sander 1 would become too small to arrange interior structures appropriately in the housing 2. Therefore, the angle of the attached battery 40 relative to the vertical line may preferably be set at an angle not greater than 30 degrees. It is to be understood that the above-described advantages of the tilted position, such as the properly dimensioned holding portion and the center of gravity brought toward the center, of the battery 40 can be brought even by setting the angle of the attached battery 40 (i.e., angle of the longitudinal direction of the battery 40) relative to the vertical line at an angle of 0 degrees. Therefore, it may be preferable that the longitudinal direction of the battery 40 as attached be oriented at an angle not less than 0 degrees with respect to the vertical direction.

The rotation of the output shaft 4 also causes the fan 9 to make a rotational motion. When the fan 9 rotates, the vanes 9*c*, 9*d* gather air within the housing 2 toward the fan 9, and the air is ejected out by the vanes 9*c*, 9*d* of the fan 9 through the windows 2*d* provided outside the fan 9. This rotation of the fan 9 also serves to suck air, so that outside air is introduced into the housing 2 through air windows 2*e* provided at an upper portion of the housing 2, or through other openings in the housing 2.

Accordingly, when the fan 9 continues to rotate, air is continuously introduced through the air windows 2*e*, passes around the motor 30 and the output shaft 4, further passes around the output shaft-side pulley 8 and through the vents 55, and then is continuously forced out by the vanes 9*c*, 9*d* through the windows 2*d*.

Air flowing from top to bottom as described above within the housing 2 provides cooling for the interior mechanisms such as the motor 30, etc., and blows dust, if any adhered to the motor 30 or the like, off the interior mechanisms. This air is directed toward the output shaft-side pulley 8 located in the center within the housing 2, but not obstructed because the vents 55 provided in the output shaft-side pulley 8 let the air pass therethrough, and thus can be caused to flow smoothly.

In particular, the sander 1 in this embodiment includes the output shaft-side pulley 8 which is larger in diameter than the motor-side pulley 34 to reduce the speed of the rotation of the motor 30, and which is arranged in the center of the housing 2 because the output shaft 4 to which the output shaft-side pulley 8 is connected is located in the center of the housing 2. Therefore, if the vents 55 were not provided, air flowing from top to bottom within the housing 2 would be significantly blocked by the output shaft-side pulley 8. Thus, provision of the vents 55 as described above eliminates the possible obstructions to the flow of air, thus bringing considerable advantages.

Air containing dust is discharged through the dust collection tube 9*a* fixed to the connection portion 2*b*. The fan 9 serves as a weight for adjusting the rotation mode of the output shaft 4 to which the pad 10 is attached.

The sander 1 includes the upper portion 2*a* of the housing 2 configured as a holding portion. Since the battery attachment portion 42 is angled with respect to the output shaft 4 (the center of the sander 1) so that its lower portion is in an inner position closer to the output shaft 4 while its upper portion is in an outer position farther from the output shaft 4, the battery 40 is attachable in a position tilted at the same angle. When the battery 40 having an elongated shape is attached, its longitudinal direction is oriented at an angle greater than 0 degrees with respect to the vertical direction, such that a lower portion of the battery 40 is in a position shifted inward farther than an upper portion of the battery 40.

Accordingly, the holding portion can be dimensioned to have a sufficiently large area, and the battery 40 as a relatively heavy part can be disposed in a position closer to the output shaft 4 located in the center of the sander 1. Therefore, the upper portion 2*a* configured as a holding portion can be dimensioned large enough for an operator's manipulation, while the position of the center of gravity of the sander 1 can be brought toward the center of the sander 1 so that high stability of the sander 1 can be ensured. As a result, providing the easy-to-hold holding portion and bringing the center of gravity closer to the center of the sander 1 can make the sander 1 easier to operate. Further, the effect of vibrations which may occur during the operation of the sander 1 can be mitigated, because of the improved position of the center of gravity in the sander 1. Therefore, the stability in operation of the sander 1 can be improved.

Since the motor 30 is disposed on a side opposite to the battery 40 with the holding portion positioned therebetween, the relatively heavy two members, battery 40 and motor 30, are arranged symmetrically with respect to the holding portion, so that the weight balance can be improved and the operability and stability can be improved.

The rotation of the motor 30 is transmitted with a reduced speed to the output shaft 4 and causes the pad 10 attached thereto to make a rotational and eccentric motion. In this configuration, the performance such as accuracy in polishing operation can be improved in comparison with the sander 1 having a pad which does not make an eccentric motion. In exchange for this improvement in performance, likelihood of producing vibrations would be increased. However, the sander 1 configured according to this embodiment has an improved weight balance due to attachment of the battery 40 in a tilted position and other reasons mentioned above, and thus its improved operability and stability can effectively compensate such vibrations.

Furthermore, since an inner edge of a lower portion of the battery 40 is positioned inward beyond an outer edge of the pad 10, the weight of the battery 40 can be placed on the pad 10 in a substantially vertical direction through the output shaft 4. Thus, vibrations which would be produced by reaction force received from the pad 10 during the polishing operation or the like can be effectively compensated due to its improved weight balance.

The longitudinal direction of the battery 40 as attached is angled at an angle greater than 0 degrees and not greater than 30 degrees with respect to the vertical direction. In this configuration, the sander 1 can be provided with a sufficiently large holding portion, proper weight balance can be realized, and the sander 1 can be designed to have a miniaturized body while making a sufficiently large inner space for the other interior structures.

In addition, since the upper edges or heights of the battery 40 as attached and the holding portion are aligned with each other, the sander can be designed to make the battery 40 less likely to interfere with the operator's hand, arm and the like, and the hand and arm and the like can be put on the battery 40 and the holding portion formed contiguously with an upper portion of the battery 40.

Moreover, in the sander 1, the output shaft 4 is not directly connected to the rotation shaft 32 of the motor 30, but connected to the rotation shaft 32 via a speed reducer which includes the output shaft-side pulley 8, the motor-side pulley 34 and the belt as described above, and the fan 9 is provided on the output shaft 4. Since the fan 9 is provided on the output shaft 4 connected via the speed reducer to the rotation shaft 32 as described above, it is possible to arrange the motor 30, rotation shaft 32, output shaft 4, ball bearings 6, 7, and fan 9 separately (without the need to place them one on top of another as in a case where the fan 9 is directly connected to the rotation shaft 32) laterally on the motor 30 side and on the output shaft 4 side. Accordingly, the interior structures of the sander 1 can be arranged without requiring a vertically large space, so that the sander 1 can be designed to have a reduced height compact body. This configuration is particularly advantageous in the palm-type sander 1 having its upper portion 2 configured as a holding portion in that it can be made easy to hold, easy to operate, and thus conformable to this particular type.

Furthermore, the sander 1 in which the rotation shaft 32 is connected via the speed reducer to the output shaft 4 on which the fan 9 is provided can be configured to include an upsized fan 9 without the need to have the housing 2 laterally protruding farther than that of the existing sander in which the fan 9 is directly provided on the rotation shaft 32. To be more specific, in this embodiment, the center of the fan 9 does not have to be aligned with the rotation shaft 32 located at the center of the motor 30, and thus the peripheral edge of the fan 9 can be located under the motor 30, so that the fan 9 can be upsized without increasing the size of the housing 2 laterally. Accordingly, since the fan 9 can be designed to be large enough while maintaining the compactness of the sander 1 in entirety, the fan 9 having an increased efficiency can be adopted in the sander 1. The efficiency of the fan 9 in this embodiment is lower than that which is directly provided on the rotation shaft 32 because the reduced speed of rotation makes the rpm of the fan 9 lower by its reduction ratio. However, the increased size of the fan 9 can make the efficiency higher to the extent enough to cover the degree of efficiency reduced by the speed reducer, and the fan 9 designed to produce a sufficient quantity of airflow for cooling the sander 1 or other purposes can be provided.

Since the output shaft-side pulley 8 has vents 55, air forced to flow by the fan 9 can be allowed to pass through the vents 55, so that airflow is not obstructed by the output shaft-side pulley 8 which should be disposed in the center within the housing 2 because the output shaft-side pulley 8 is provided on the output shaft 4. As a result, the passage of air can be made smooth, and the cooling and other functions of the fan 9 can be performed efficiently.

Since the fan 9 includes thick portions 9*e*, 9*f* (balance portion) for increasing the weights of peripheral edges of the fan 9 at which the thick portions 9*e*, 9*f* are provided, the rotation mode of the pad 10 actuated by the output shaft 4 can be adjusted by configuring the positions and weights of the thick portions 9*e*, 9*f* (i.e., the fan 9 with the thick portions 9*e*, 9*f* serves as counterweight). Therefore, adjustment can be made to the rotation of the pad 10 effectively, in particular, for the sander 1 configured such that the pad 10 makes a relatively complicate eccentric and rotational motion.

Additionally, in a position of the housing 2 corresponding to the position of the fan 9, a portion of the housing 2 at both sides of the fan 9 is configured as extension portions 2*c* which extend outward, and thus even if the fan 9 is upsized, the sander 1 can be configured to accommodate the fan 9 without increasing all of its dimensions. Furthermore, the portions of the housing 4, other than the portions in which the extension portions 2*c* are provided (in the present embodiment, the portions above the extension portions 2*c*) are configured as constrictions 44. Therefore, the sander 1 may be rendered easy to hold, and configured to be held by a hand with fingers fitted to the constriction 44 while the hand is kept from slipping by the extension portions 2*c*. In this embodiment where the extension portions 2*c* are disposed under the constrictions 44, particularly, the fan 9 can be disposed adjacent the pad 10, and the risk of the hand slipping toward the pad 10 can be diminished.

Furthermore, in the sander 1, a power switch having, at least, a function of powering off (button 3*a*) and a speed change switch having a function of changing the rotation speed of the pad 10 (button 3*b*) are arranged on the flat surface 60 formed outside the housing 2. In this configuration, the speed changing operation, as well as the power on/of switching operation, can be performed in the same mode of operation, by one and the same finger with increased ease, and thus the operability of the sander 1 can be considerably improved.

Moreover, since the buttons 3*a*, 3*b* are disposed beside the holding portion (upper portion 2*a* of the housing 2), the buttons 3*a*, 3*b* can be manipulated by a hand which holds the holding portion. Therefore, the operation of the sander 1 can be performed accurately and easily.

Furthermore, since the buttons 3*a*, 3*b* are arranged laterally side by side, several kinds of operation commands can be issued simply by moving a finger and pressing down any of the buttons corresponding the designated command. Thus, the operability of the sander, in particular that of a type in which a hand is applied from above, can be further improved.

Furthermore, since the distance between the centers of the buttons 3*a*, 3*b* is smaller than the width of the laterally narrowest portion of the housing 2 (the distance between most deeply recessed portions of the constriction 44), a finger can be applied to a designated button to be pressed down without the need for the user moving his/her finger/hand over a long distance. Therefore, the sander 1 can be rendered easier to operate In addition, since the flat surface 60 on which the buttons are arranged is tilted (positioned to slope) with an upper side positioned toward the center of the sander 1 (inward), the edge of the flat surface adjacent to the top of the upper portion 2*a* can be contoured so as not to be square or acutely cornered so that a finger applied to press the button is not obstructed by such a square or acute corner. Thus, the finger is allowed to be guided smoothly to the designated button, so that the buttons can be rendered easier to press down and the sander 1 can be designed to be easier to operate.

The present invention is not limited to the above-described embodiments, a various modifications and changes may be made to the configuration, function, arrangement, kind and number of each component without departing from the scope of the present invention.

For example, the battery may be attached directly into an engageable portion of a housing without utilizing a battery attachment portion provided in the housing to guide the battery being slid and attached thereto, in other words, a direct attachment scheme may be adopted instead of the aforementioned slide attachment scheme. Alternatively, a box-like holder with a lid or without a lid may be provided in the housing so that the battery is attachable. One or more of the parts which may include the battery attachment portion, the fan, the dust collection tube, etc. may be omitted. The numbers of various bearings, screws and buttons may be increased or reduced. The fan may be provided only with a dust collecting function but without consideration given to the weight balance. The output shaft may be directly connected to the inside of the inner race of the ball bearing of the pad. The buttons provided may be replaced with various mode switching buttons and/or power-on/off combination switching buttons. The buttons may be modified into lever-type switches. The belt and pulley may be replaced with gears (with vents). The screws may be replaced with pins. The lower portion of the fan may not be disposed in an inside of the inner race of the ball bearing, wherein the output shaft is directly fixed to the fan. The sander may be configured to be rechargeable while a battery is attached thereto, instead of replacing a fully-charged battery. A non-rechargeable battery may be used instead of the rechargeable battery. The sander may be configured to derive electric power from a household alternating-current power supply or other power sources, alone or in combination with a battery. The numbers of the extension portion and/or the constriction and/or the windows/holes/vents, etc. of the housing may be increased or reduced.

The vents may be provided in at least one member selected among internal mechanisms housed in the housing, other than the output shaft-side pulley or together with the output shaft-side pulley. The vents provided additionally in the internal members can allow air to flow therethrough, so that ventilation inside the housing can be improved. Particularly, such vents, if provided in the motor-side pulley, allows air to smoothly pass through the motor-side pulley located around the output shaft-side pulley, i.e., in the center of the inside space of the housing, and thus the fan's cooling or other functions can be improved.

The number, shape, dimensions and/or arrangement of the vent(s) may be changed, for example, if a single vent suffices for the intended purposes, the number of vents may be one. Conversely, the number of vents may be increased or reduced as desired. The shape of each vent may be circular, or the like. The arrangement of the vents may be asymmetric where appropriate. Some of the plurality of vents may be configured to be different in shape and/or dimensions from others.

As for the fan, the vanes, thick portions and other portions may be modified in shape and/or number. Part of each vane may be designed so as to have the weight function as of the thick portion (balance portion), or may be designed to only have the ventilation function without consideration given to its weight. The output shaft may be directly fixed to the fan, that is, the lower portion of the fan may not be disposed in an inside of the inner race of the ball bearing.

The buttons may be modified to have various sizes, shapes and/or protruding dimensions different from each other. Instead of providing a common button unit, individual units for respective buttons may be arranged in combination. The power button may be configured as a power-on/off combination switch. The speed change button may be configured to change the rotation speed only during the power-on state, but not during the power-off state. The buttons may be arranged along an oblique direction or a vertical direction. The buttons, or a surface on which the buttons are arranged, may be provided on the left side or the right side of the holding portion. Any or all of the buttons may be configured as a slide switch or other type of the switch.

Any other button such as a mode-select switch may be provided alternatively or additionally, or such mode-select switch may be configured to also have a power-on/off function. A lever-type switch may be adopted instead of any of the buttons.

The present invention may be applied to any other type of sander, other than the "orbital sander" described above in which the pad makes an orbital and rotational motion It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A sander comprising:

a housing;

an upper portion of the housing configured as a holding portion;

an output shaft that rotates around a rotational axis, the rotational axis of the output shaft extending in a vertical direction inside the housing and being configured to be aligned with the upper portion;

a pad configured to be driven about the output shaft;

a battery removably attached to an outside of the housing, the battery is removably attached to an attachment portion of the housing; and a motor powered by the battery and configured to drive the pad, the motor being disposed inside the housing, wherein the battery is elongated along a longitudinal axis such that when the battery is attached to the housing, the longitudinal axis is oriented at an angle not less than 0 degrees with respect to the vertical direction, the motor is disposed on a side opposite to the attachment portion with respect to a position of the holding portion, the rotational axis of the output shaft is provided perpendicular to the pad and parallel to a rotation shaft of the motor, and the battery is arranged such that the longitudinal axis is oriented at an angle not less than 0 degrees with respect to the rotation shaft of the motor, and the battery is slidably attached to the attachment portion from a direction parallel to the longitudinal axis, and a height of the housing in the vertical direction along the rotational axis of the output shaft is longer than a longest length of the housing in a horizontal direction, from a front of the housing to a back of the housing.

2. The sander according to claim 1, wherein the pad is configured to receive a reduced speed driving force derived from a driving force of the motor to make a rotational motion and an eccentric motion.

3. The sander according to claim 1, wherein an inner edge of a lower portion of the battery as attached is positioned inward beyond an outer edge of the pad.

4. The sander according to claim 1, wherein the longitudinal axis of the battery is angled at an angle greater than 0 degrees and not greater than 30 degrees with respect to the vertical direction.

5. The sander according to claim 1, wherein an upper edge of an upper portion of the battery as attached is positioned in alignment with an upper edge of the holding portion in the vertical direction.

6. The sander according to claim 1, further comprising a fan provided on the output shaft, wherein the rotation shaft of the motor is connected to the output shaft via a speed reducer configured to reduce a speed with which a rotation of the rotation shaft is transmitted to the output shaft.

7. The sander according to claim 6, wherein the speed reducer includes a reduction member which has a vent.

8. The sander according to claim 1, further comprising a power switch and a speed change switch for the motor, wherein the power switch and the speed change switch are arranged on a flat surface.

9. The sander according to claim 8, wherein the flat surface is disposed beside the holding portion.

10. The sander according to claim 1, wherein the longitudinal axis of the battery is angled at an angle greater than 0 degrees and not greater than 14 degrees with respect to the vertical direction.

11. The sander according to claim 1, wherein the longitudinal axis of the battery is angled at an angle greater than 14 degrees and not greater than 30 degrees with respect to the vertical direction.

12. The sander according to claim 1, wherein the longitudinal axis of the battery intersects an axis passing through the output shaft at a position below the upper portion.

13. The sander according to claim 1, wherein the output shaft is extending at a substantially center portion of the housing.

* * * * *